US009435593B2

(12) United States Patent
McGinty

(10) Patent No.: US 9,435,593 B2
(45) Date of Patent: Sep. 6, 2016

(54) CHARGING HANDLE ENGAGEMENT WITH CARRIER KEY OF FIREARM

(71) Applicant: S. I. DEFENSE, INC., Kalispell, MT (US)

(72) Inventor: Aaron A. McGinty, Kalispell, MT (US)

(73) Assignee: FALKOR SID, INC., Kalispell, MT (US)

( * ) Notice: Subject to any disclaimer, the term of this patent is extended or adjusted under 35 U.S.C. 154(b) by 0 days.

(21) Appl. No.: 14/632,706

(22) Filed: Feb. 26, 2015

(65) Prior Publication Data

US 2016/0076834 A1 Mar. 17, 2016

Related U.S. Application Data

(63) Continuation-in-part of application No. 14/581,694, filed on Dec. 23, 2014, now abandoned, and a continuation-in-part of application No. 14/579,893, filed on Dec. 22, 2014, now abandoned.

(60) Provisional application No. 61/949,907, filed on Mar. 7, 2014, provisional application No. 61/920,164, filed on Dec. 23, 2013, provisional application No. 61/920,026, filed on Dec. 23, 2013.

(51) Int. Cl.

| | |
|---|---|
| ***F41F 5/00*** | (2006.01) |
| ***F41A 3/72*** | (2006.01) |
| ***F41A 5/24*** | (2006.01) |
| ***F41A 5/28*** | (2006.01) |
| ***F41A 35/06*** | (2006.01) |

(52) U.S. Cl.

CPC .. *F41A 3/72* (2013.01); *F41A 5/24* (2013.01); *F41A 5/28* (2013.01); *F41A 35/06* (2013.01)

(58) Field of Classification Search

CPC ..... F41A 3/72; F41A 5/24; F41A 5/28; F41A 35/06

USPC ..... 89/1.4, 193, 191.01, 194

See application file for complete search history.

(56) References Cited

U.S. PATENT DOCUMENTS 3,225,653 A * 12/1965 Packard ..... F41A 3/72 42/16

6,311,603 B1 * 11/2001 Dunlap ..... F41A 3/72 42/2

(Continued)

OTHER PUBLICATIONS

U.S. Appl. No. 61/920,008, filed Dec. 23, 2013, titled "Quick-Release Barrel Firearm", Inventor: Aaron A. McGinty.

(Continued)

*Primary Examiner* — Michelle R Clement

(74) *Attorney, Agent, or Firm* — Bennet K. Langlotz; Langlotz Patent & Trademark Works, Inc.

(57) ABSTRACT

Firearms that pull back the carrier using a charging handle and carriers and charging handles for firearms. In various embodiments, the charging handle engages the carrier at a gas key or tab thereon. In some embodiments, the charging handle has a bridge or engagement face located between a rearward end and a forward end of the charging handle. In particular embodiments, the bridge extends from a left wall to a right wall of the charging handle. In some embodiments, the bridge, the left wall, the right wall, and a top wall are all one piece and a stem of the charging handle has an open bottom between the left and right walls. In various embodiments, the bridge does not extend below the left or right wall, the tab on the gas key extends upward between the left and right walls to engage the bridge on the charging handle, or both.

17 Claims, 3 Drawing Sheets

(56) References Cited

U.S. PATENT DOCUMENTS

| | | | | |
|---|---|---|---|---|
| 7,841,118 | B2 * | 11/2010 | VanVlymen | F41A 3/12 42/70.08 |
| 8,181,563 | B1 * | 5/2012 | Peterken | F41A 11/02 89/191.01 |
| 8,307,750 | B2 * | 11/2012 | Vuksanovich | F41A 5/28 89/191.01 |
| 8,505,428 | B2 * | 8/2013 | Overstreet | F41A 3/72 89/1.4 |
| 8,561,517 | B2 * | 10/2013 | Brown | F41A 3/72 89/1.4 |
| 8,567,301 | B1 * | 10/2013 | Sharron | F41A 3/72 89/1.4 |
| 8,863,632 | B1 * | 10/2014 | O'Malley | F41A 3/72 42/16 |
| 8,893,608 | B2 | 11/2014 | Kramer | |
| 8,899,138 | B2 | 12/2014 | Brown | |
| 8,910,406 | B1 | 12/2014 | Huang et al. | |
| 8,950,312 | B2 * | 2/2015 | Gomez | F41A 3/38 42/25 |
| 8,997,620 | B2 * | 4/2015 | Brown | F41A 5/24 89/1.4 |
| 9,109,848 | B2 * | 8/2015 | Brown | F41A 3/72 |
| 2008/0276797 | A1 * | 11/2008 | Leitner-Wise | F41A 3/12 89/191.01 |
| 2009/0260269 | A1 * | 10/2009 | VanVlymen | F41A 3/12 42/69.02 |
| 2010/0000396 | A1 * | 1/2010 | Brown | F41A 3/72 89/1.4 |
| 2010/0162604 | A1 * | 7/2010 | Dubois | F41A 21/482 42/18 |
| 2011/0061523 | A1 * | 3/2011 | Webb | F41A 3/42 89/128 |
| 2011/0174139 | A1 * | 7/2011 | Olsen | F41A 35/06 89/1.4 |
| 2011/0265636 | A1 * | 11/2011 | Overstreet | F41A 3/72 89/1.4 |
| 2012/0216439 | A1 * | 8/2012 | Barrett | F41A 3/26 42/75.02 |
| 2012/0291612 | A1 * | 11/2012 | Kincel | F41A 35/06 89/1.4 |
| 2012/0318124 | A1 * | 12/2012 | Brown | F41A 3/72 89/1.4 |
| 2013/0092014 | A1 * | 4/2013 | Kincel | F41A 3/72 89/1.4 |
| 2013/0152443 | A1 * | 6/2013 | Gomez | F41A 3/26 42/16 |
| 2013/0174457 | A1 * | 7/2013 | Gangl | F41A 3/72 42/16 |
| 2013/0192113 | A1 * | 8/2013 | Melville | F41A 7/00 89/1.4 |
| 2013/0284008 | A1 * | 10/2013 | Pizano | F41A 7/02 89/193 |
| 2014/0041518 | A1 | 2/2014 | Neitzling | |
| 2014/0060293 | A1 * | 3/2014 | Gomez | F41A 3/72 89/1.4 |
| 2014/0060294 | A1 * | 3/2014 | Brown | F41A 5/24 89/1.4 |
| 2014/0224103 | A1 * | 8/2014 | Brown | F41A 3/72 89/1.4 |
| 2014/0318356 | A1 * | 10/2014 | Cupps | F41A 3/72 89/1.4 |
| 2014/0345444 | A1 * | 11/2014 | Hillman | G01N 15/06 89/1.4 |
| 2015/0192376 | A1 * | 7/2015 | Dickinson | F41A 3/72 89/1.4 |
| 2015/0226501 | A1 * | 8/2015 | Gibbens | F41A 3/66 42/16 |
| 2015/0233657 | A1 * | 8/2015 | Barker | F41A 35/06 89/1.4 |
| 2015/0241149 | A1 * | 8/2015 | McMillen, IV | F41A 5/28 89/193 |
| 2015/0308760 | A1 * | 10/2015 | Gomez | F41A 3/72 89/1.4 |
| 2015/0308762 | A1 * | 10/2015 | McGinty | F41A 3/72 89/1.4 |

OTHER PUBLICATIONS

U.S. Appl. No. 14/579,797, filed Dec. 22, 2014, titled "QuickReleaseFirearm", Inventor: Aaron A. McGinty.
U.S. Appl. No. 61/920,026, filed Dec. 23, 2013, titled "Internal Latch in Charging Handle of Firearm", Inventor: Aaron A. McGinty.
U.S. Appl. No. 14/579,893, filed Dec. 22, 2014, titled "Internal Latch in Charging Handle of Firearm", Inventor: Aaron A. McGinty.
U.S. Appl. No. 61/920,164, filed Dec. 23, 2013, titled "Intermediate Charging Handle Engagement With Carrier of Firearm", Inventor: Aaron A. McGinty.
U.S. Appl. No. 14/581,694, filed Dec. 23, 2014, titled "Intermediate Charging Handle Engagement With Carrier of Firearm", Inventor: Aaron A. McGinty.
U.S. Appl. No. 61/920,213, filed Dec. 23, 2013, titled "Firearm Capable of Ejecting Shell Casing on Either Side", Inventor: Aaron A. McGinty.
U.S. Appl. No. 14/581,755, filed Dec. 23, 2014, titled "Dual Injection Port Firearm", Inventor: Aaron A. McGinty.
U.S. Appl. No. 61/920,234, filed Dec. 23, 2013, titled "Cross Ventilation Through Ejection Ports of Firearm", Inventor: Aaron A. McGinty.
U.S. Appl. No. 61/925,768, filed Jan. 10, 2014, titled "Ambidextrous Bolt Catch of Firearm", Inventor: Aaron A. McGinty.
U.S. Appl. No. 14/594,924, filed Jan. 12, 2015, titled "Ambidextrous Bolt Catch and Magazine Release and Firearm", Inventor: Aaron A. McGinty.
U.S. Appl. No. 61/932,874, filed Jan. 29, 2014, titled "Bolt Buffer and Firearm", Inventor: Aaron A. McGinty.
U.S. Appl. No. 14/608,894, filed Feb. 10, 2015, titled "Bolt Buffer and Firearm", Inventor: Aaron A. McGinty.
U.S. Appl. No. 61/936,022, filed Feb. 5, 2014, titled "Carrier Guide and Firearm", Inventor: Aaron A. McGinty.
U.S. Appl. No. 14/593,116, filed Jan. 9, 2015, titled "Carrier Guide and Firearm", Inventor: Aaron A. McGinty.
U.S. Appl. No. 61/943,860, filed Feb. 24, 2014, titled "Handguard With Integrated POD and Firearm", Inventor: Aaron A. McGinty.
U.S. Appl. No. 14/625,183, filed Feb. 18, 2015, titled "Handguard With Integrated POD and Firearm", Inventor: Aaron A. McGinty.
U.S. Appl. No. 61/974,322, filed Apr. 2, 2014, titled "Ambidextrous Magazine Release and Firearm", Inventor: Aaron A. McGinty.

* cited by examiner

DETAIL A

SECTION B-B

CHARGING HANDLE ENGAGEMENT WITH CARRIER KEY OF FIREARM

RELATED PATENT APPLICATIONS

This patent application claims priority to U.S. Provisional Patent Application No. 61/949,907, filed on Mar. 7, 2014, titled: CHARGING HANDLE ENGAGEMENT WITH CARRIER KEY OF FIREARM. This patent application also claims priority as a continuation-in-part (CIP) patent application to U.S. Non-Provisional patent application Ser. No. 14/581,694 filed on Dec. 23, 2014, titled: INTERMEDIATE CHARGING HANDLE ENGAGEMENT WITH CARRIER OF FIREARM, which claims priority to U.S. Provisional Patent Application No. 61/920,164, filed on Dec. 23, 2013, also titled: INTERMEDIATE CHARGING HANDLE ENGAGEMENT WITH CARRIER OF FIREARM. patent application Ser. No. 14/581,694 also claims priority to U.S. Provisional Patent Application No. 61/920,026, filed on Dec. 23, 2013, titled, INTERNAL LATCH IN CHARGING HANDLE OF FIREARM and also to U.S. Provisional Patent Application No. 61/949,907, filed on Mar. 7, 2014, titled CHARGING HANDLE ENGAGEMENT WITH CARRIER KEY OF FIREARM. This patent application also claims priority as a continuation-in-part (CIP) patent application to U.S. Non-Provisional patent application Ser. No. 14/579,893 filed on Dec. 22, 2014, titled: INTERNAL LATCH IN CHARGING HANDLE OF FIREARM, which claims priority to U.S. Provisional Patent Application No. 61/920,026, filed on Dec. 23, 2013, also titled, INTERNAL LATCH IN CHARGING HANDLE OF FIREARM; U.S. Provisional Patent Application No. 61/920,164, filed on Dec. 23, 2013, titled: INTERMEDIATE CHARGING HANDLE ENGAGEMENT WITH CARRIER OF FIREARM; and U.S. Provisional Patent Application No. 61/949,907, filed on Mar. 7, 2014, titled CHARGING HANDLE ENGAGEMENT WITH CARRIER KEY OF FIREARM. All of these priority patent applications have at least one inventor in common with the current patent application and the same assignee. In addition, the contents of all of these priority provisional patent applications are incorporated herein by reference. If there are any conflicts or inconsistencies between this patent application and the patent applications incorporated by reference, however, this patent application governs herein.

FIELD OF THE INVENTION

Various embodiments of this invention relate to firearms. Particular embodiments relate to firearms having charging handles and systems and methods of engaging carriers with a charging handles.

BACKGROUND OF THE INVENTION

Firearms have been used for several centuries for various purposes including as weapons for warfare, law enforcement, self defense, hunting, and target practice. Although many new weapons and weapon systems have been developed, firearms are still widely used and soldiers are trained in firearm use and carry firearms in essentially all armies throughout the world. Over time, firearms have been improved in many ways, but opportunities for improvement still exist in particular areas and for particular aspects of these devices.

Firearms have been built that use energy from the firing of one round to load the next round into the chamber for firing. In various configurations, the first round to be fired must be loaded manually and the firearm must be cocked (e.g., the bolt or carrier pulled back) to fire the first round. For this purpose, firearms have been equipped with charging handles that are operated (e.g., pulled back) by the operator in order to load the first round and prepare the weapon for firing the first round. Charging handles have been used that engaged the bolt or carrier with a lateral projection, tang, or drop down tab at the forward end or tip of the charging handle. The tang, tip or drop down tab of the charging handle previously extended below the side walls of the charging handle to engage the forward part of the carrier. The operator of the firearm would pull the charging handle rearward until it stopped, which would pull the carrier rearward and compress a buffer spring. The operator would then let the charging handle return forward and the forward motion of the carrier would charge the weapon. The operator would then push the charging handle forward into its stowed position and the rifle would then be charged and ready to fire.

In prior firearms, the tang, tip or drop down tab of the charging handle, however, has been know to wear, deform, or even break, for instance, from repeated use, particularly from rough use or where other issues exist with the mechanism. Cracks, fractures, or bending has occurred in past charging handles, for example, where the tang, tip or drop down tab of the charging handle extends below the side walls of the stem of the charging handle. A need or potential for benefit or improvement exists for firearms wherein the charging handle engages the carrier in a more robust manner that is less prone to wear, damage, or failure. Room for improvement exists over the prior art in these and other areas that may be apparent to a person of ordinary skill in the art having studied this document.

SUMMARY OF PARTICULAR EMBODIMENTS OF THE INVENTION

This invention provides, among other things, firearms with improved systems and methods of engagement between the charging handle and the carrier, and charging handles and carriers for such firearms. Various embodiments provide, for example, as an object or benefit, that they partially or fully address or satisfy one or more of the needs, potential areas for benefit, or opportunities for improvement described herein or known in the art. Some embodiments provide firearms, for example, with charging handles that engage the carrier at a bridge or an engagement face on the charging handle, for instance, located between a rearward first end and a forward second end of the charging handle. In various embodiments, the bridge or engagement face of the charging handle engages the gas key, gas key tab, or carrier key of the carrier, as examples. In a number of embodiments, the engagement face is a certain percentage of the length of the charging handle from the second end, or within a range of lengths. In addition, or instead, in some embodiments, the charging handle has a stem having a top wall, a left wall, and a right wall, and the bridge or engagement face extends, in a number of embodiments, from the left wall to the right wall.

In a number of embodiments, improvements to firearms herein provide for firearms that are more reliable, that last longer, that are more adaptable, that can be used in conditions that are more extreme, that handle abuse well, that work better, that are easier to use, that are easier to maintain, that are less expensive to manufacture, that have a lower lifecycle cost, or a combination thereof. Further, embodiments, besides firearms, include particular charging handles and carriers for firearms, for example, with features described herein.

Specific embodiments include various firearms that each include a charging handle and a carrier having a gas key. Further, in a number of these embodiments, the charging handle engages the carrier at the gas key. Still further, in some such embodiments, the gas key includes a tab, for example, that engages the charging handle. Even further, in particular embodiments, the charging handle includes a stem that has a left wall, a right wall, and a bridge, for example, that extends from the left wall to the right wall, and in a number of embodiments, the tab (i.e., on the gas key) extends between the left wall and the right wall (i.e., of the charging handle), for instance, to engage the bridge. In various embodiments, the bridge engages the gas key.

Furthermore, in various embodiments, the left wall is attached to the top wall, the right wall is attached to the top wall, or both. Moreover, in some embodiments, as examples, the left wall, the top wall, and the right wall are all one piece, the left wall is substantially perpendicular to the top wall, the right wall is substantially perpendicular to the top wall, the left wall is substantially parallel to the right wall, or a combination thereof. Further, in particular embodiments, the bridge, the left wall, the right wall, and the top wall are all one piece, the stem has an open bottom between the left wall and the right wall, or both. Still further, in some embodiments, the bridge is perpendicular to the left wall and to the right wall. Even further, in certain embodiments, the bridge extends to the top wall. Further still, in various embodiments, the bridge includes an engagement face that engages the gas key. In particular embodiments, for example, the engagement face is concave.

Further, in a number of embodiments, the charging handle has a rearward first end, a forward second end, and a length from the first end to the second end. In certain embodiments, for example, the charging handle engages the gas key at least 10 percent of the length from the second end of the charging handle. Still further, in some embodiments, the bridge engages the gas key at least 50 percent of the length from the first end of the charging handle. Even further, in some of these embodiments, the charging handle includes a stem including a top wall, a left wall attached to the top wall, a right wall attached to the top wall, and a bridge that extends from the left wall to the right wall, the left wall is substantially perpendicular to the top wall, the right wall is substantially perpendicular to the top wall, or a combination thereof. Further still, in particular such embodiments, the left wall is substantially parallel to the right wall, the bridge, the left wall, the right wall, and the top wall are all one piece, the stem has an open bottom between the left wall and the right wall, or a combination thereof. Even further still, in some such embodiments, the bridge extends to the top wall, the bridge includes an engagement face that engages the gas key, or both.

Additionally, in some embodiments in which the charging handle includes a stem including a left wall, a right wall, and a bridge that extends from the left wall to the right wall, the bridge engages the gas key and yet the bridge does not extend below either the left wall or the right wall. In certain embodiments, for example, the firearm is an AR-15. Moreover, additional examples of firearms are described herein.

Other specific embodiments include various charging handles for firearms, as other examples. In particular embodiments, for instance, the firearm has a carrier having a gas key, and the charging handle includes an engagement face, for instance, that engages the carrier at the gas key. Further, in some such embodiments, for example, the charging handle engages a tab on the gas key. Still further, in particular embodiments, the charging handle includes a stem, for instance, including a top wall, a left wall attached to the top wall, a right wall attached to the top wall, and a bridge, for example, that extends from the left wall to the right wall. Even further, in some such embodiments, the bridge engages the gas key, the left wall is substantially perpendicular to the top wall, the right wall is substantially perpendicular to the top wall, or a combination thereof. Further still, in some embodiments, the left wall is substantially parallel to the right wall, the bridge, the left wall, the right wall, and the top wall are all one piece, the stem has an open bottom, for instance, between the left wall and the right wall, or a combination thereof, as examples. Moreover, in certain embodiments, for example, in which the charging handle includes a stem having a left wall, a right wall, and a bridge that extends from the left wall to the right wall, the bridge engages the gas key, the left wall is substantially parallel to the right wall, the bridge does not extend below either the left wall or the right wall, or a combination thereof. Other embodiments of charging handles, however, may differ.

Still other specific embodiments include various carriers for firearms. In a number of embodiments, the firearm has a charging handle and the carrier includes a gas key that includes a tab that engages the charging handle of the firearm, for example. Further, in particular of these embodiments, the charging handle includes a stem including a left wall, a right wall, and a bridge, for instance, that extends from the left wall to the right wall, and the tab on the gas key of the carrier extends upward, for example, between the left wall and the right wall, for instance, to engage the bridge on the charging handle. In addition, various other embodiments of the invention are also described herein, and other benefits of certain embodiments may be apparent to a person of skill in this area of technology.

BRIEF DESCRIPTION OF THE DRAWINGS

The drawings provided herewith illustrate, among other things, examples of certain aspects of particular embodiments. Other embodiments may differ. Various embodiments may include aspects shown in the drawings, described in the specification (including the claims), known in the art, or a combination thereof, as examples. Reference numbers on the drawings identify different parts, assemblies, aspects, or regions described in this document, and the same reference number often identifies the same part, assembly, aspect, or region in different views. In most or all instances, the left digit of each reference number corresponds to a figure number in which that part, assembly, aspect, or region is well illustrated, but other views may show other details.

DETAILED DESCRIPTION OF EXAMPLES OF EMBODIMENTS

This patent application describes, among other things, examples of certain embodiments, and certain aspects thereof. Other embodiments may differ from the particular examples described in detail herein, or may contain some aspects described herein, but not others. Various embodiments are or concern firearms, for example, having improvements over the prior art. Different embodiments include firearms, charging handles for firearms, carriers (e.g., having gas keys) for firearms, and methods concerning charging handles, carriers, or firearms, as examples.

Figure 1:
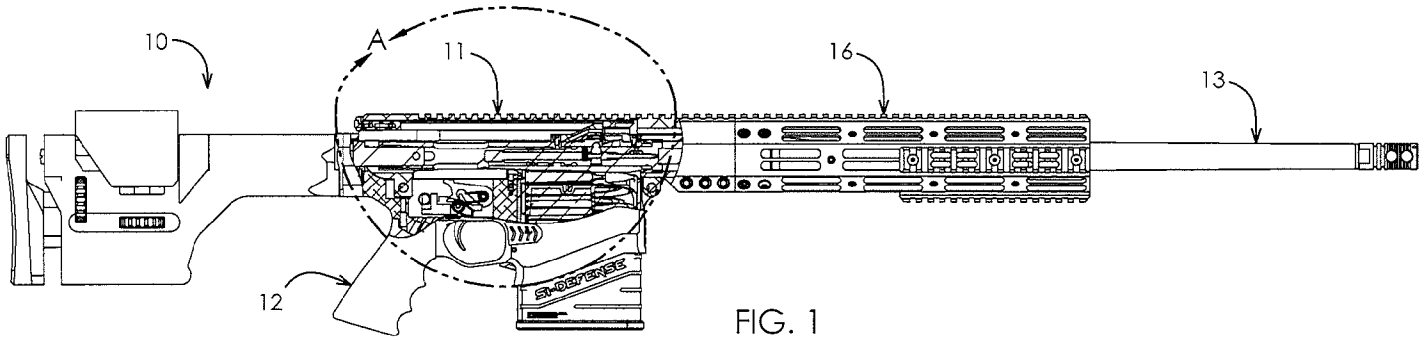
FIG. 1 is a partially cross-sectional right side view of an embodiment of a firearm that includes a charging handle and a carrier having a gas key wherein the charging handle engages the carrier at the gas key.
Figure 2:
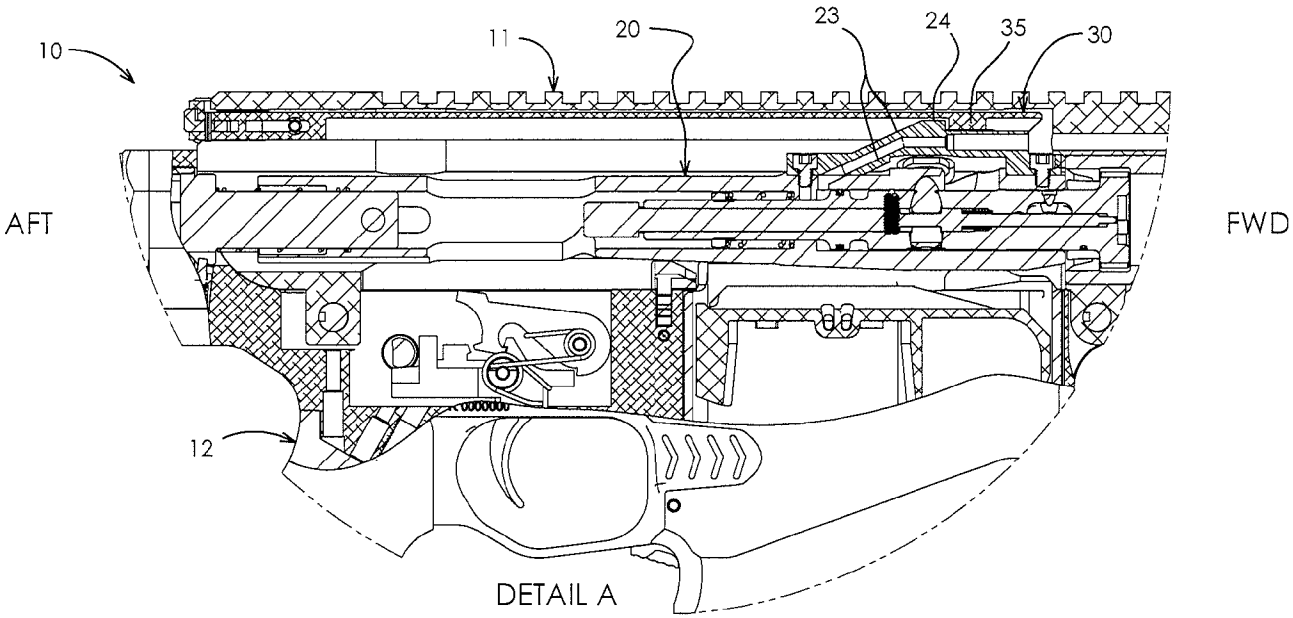
FIG. 2 is a detail cross-sectional view of part of the firearm of FIG. 1 showing, among other things, the charging handle engaging the carrier at the gas key.

FIG. 1 illustrates an example of a firearm, firearm 10, which includes upper receiver 11, lower receiver 12, barrel 13, and handguard 16, among other things. FIG. 2 illustrates that in firearm 10, charging handle 30 (also shown in FIGS. 3-5) engages carrier 20 of firearm 10. As used herein, the "carrier" can be the bolt carrier group, and can include the bolt for the firearm. In different embodiments, the charging handle (e.g., 30) engages the carrier (e.g., 20) with an intermediate feature on the charging handle (e.g., 30) such as a gusset, flange, cross member, or lateral feature, for instance, on or through the bottom (e.g., open 33 identified in FIGS. 3 and 4) of the charging handle. Bridge 35 shown in FIGS. 2-5 is an example of such an intermediate feature.

As used herein, a first part or assembly "engages" a second part or assembly if the first part or assembly pushes or moves the second part or assembly, for instance, when the first part or assembly is moved by the operator (i.e., the person who is operating the firearm). In various embodiments, engagement involves physical contact, for instance, between the first part or assembly and the second part or assembly. In some embodiments, the first part or assembly and the second part or assembly move together, for example, when the first part or assembly and the second part or assembly are engaged and the first part or assembly is pushing or moving the second part or assembly. In a number of embodiments, however, the first part or assembly and the second part or assembly move independently, or can move independently, for example, when the first part or assembly and the second part or assembly are not engaged (e.g., when the charging handle is in its stowed position, when the weapon is fired, or both).

In different embodiments, the (e.g., intermediate) feature on the charging handle (e.g., 30) that engages the carrier (e.g., 20) can be a hole, projection, tab, bridge, lateral surface, or wall, as examples. Bridge 35 on charging handle 30 is an example of such a feature and is an example of an intermediate such feature. Additionally, in a number of embodiments, the carrier (e.g., 20) has an engaging feature, such as a protrusion (e.g., tab 24 shown in FIGS. 2 and 6-8), and the engagement face (e.g., 350 identified in FIGS. 3-5), lateral feature, or bridge (e.g., 35) contacts the feature or protrusion (e.g., tab 24) when the charging handle (e.g., 30) pulls back the carrier (e.g., 20). In a number of embodiments, the charging handle (e.g., 30) or the feature of the charging handle (e.g., bridge 35) engages the gas key (e.g., 23 shown in FIGS. 2 and 6-8), gas key tab (e.g., 24), or carrier key (e.g., gas key 23) of the carrier (e.g., 20), as examples.

In a number of embodiments, for example, a firearm (e.g., 10) includes a charging handle (e.g., 30) and a carrier (e.g., 20) having a gas key (e.g., 23) and the charging handle engages the carrier at the gas key. Further, in some embodiments, a firearm includes a charging handle and a carrier having a gas key tab (e.g., 24), and the charging handle engages the carrier at the gas key tab. Even further, in some embodiments, a firearm includes a charging handle and a carrier having a carrier key (e.g., gas key 23) and the charging handle engages the carrier at the carrier key. As used herein, a "carrier key" is the same as a "gas key". Still further, in some embodiments, a firearm (e.g., 10) includes a charging handle (e.g., 30) and a carrier (e.g., 20) having a carrier key (e.g., 23) having a gas key tab (e.g., 24), and the charging handle engages the carrier at the gas key tab, as yet another example.

Figure 8:
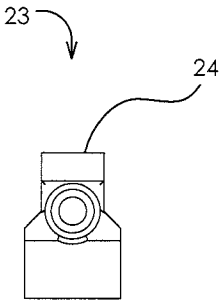
FIG. 8 is a front view of the gas key of the carrier of the firearm of FIGS. 1 and 2.
Figure 6:
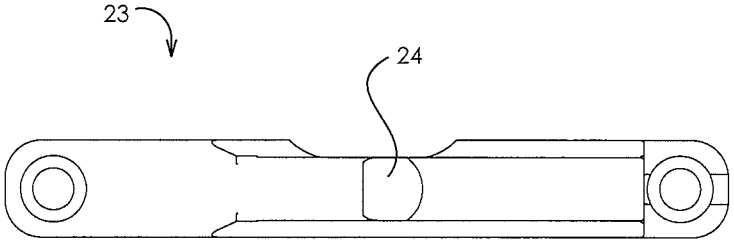
FIG. 6 is a top view of the gas key of the carrier of the firearm of FIGS. 1 and 2, showing, among other things, the gas key tab that the charging handle of FIGS. 3-5 engages.
Figure 7:
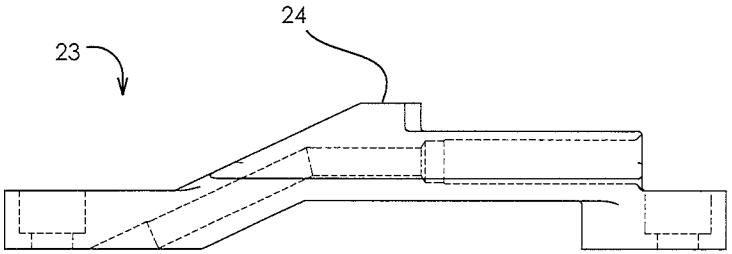
FIG. 7 is a right side view of the gas key of the carrier of the firearm of FIGS. 1 and 2, also showing, among other things, the gas key tab that the charging handle of FIGS. 3-5 engages.

In various firearms (e.g., 10), as used herein, the gas key (e.g., 23) or carrier key is a tube or tubular structure that is part of the carrier (e.g., 20) that receives and passes gas from the cartridge when the firearm is discharged. As used herein, firearms that have a gas key (e.g., 23) or a carrier key have a direct impingement system wherein gas from the fired round is directed directly to the carrier (e.g., 20) as opposed to being directed to a piston that drives the carrier through a rod. In the embodiment illustrated, interior passageways of gas key 23, that pass gas from the cartridge when the firearm is discharged, are shown in broken lines in FIG. 7. This is an example and other embodiments may differ. Further, in the embodiment illustrated, gas key 23, as depicted in FIGS. 6-8, is attached to the remainder of carrier 20 with two fasteners, such as screws (e.g., shown in FIG. 2), that pass through two holes in gas key 23 and into the remainder of the carrier, which fasteners or screws may be staked to prevent them from loosening. Other embodiments of gas keys may be attached (e.g., to the remainder of the carrier) in a different manner or may have a different number of fasteners or screws such as 1, 3, 4, or 5, as examples.

Figure 3:
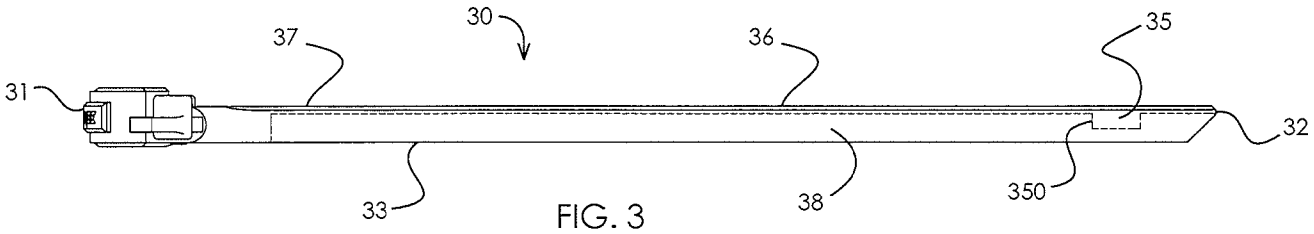
FIG. 3 is a right side view of the charging handle of the firearm of FIGS. 1 and 2.
Figure 4:
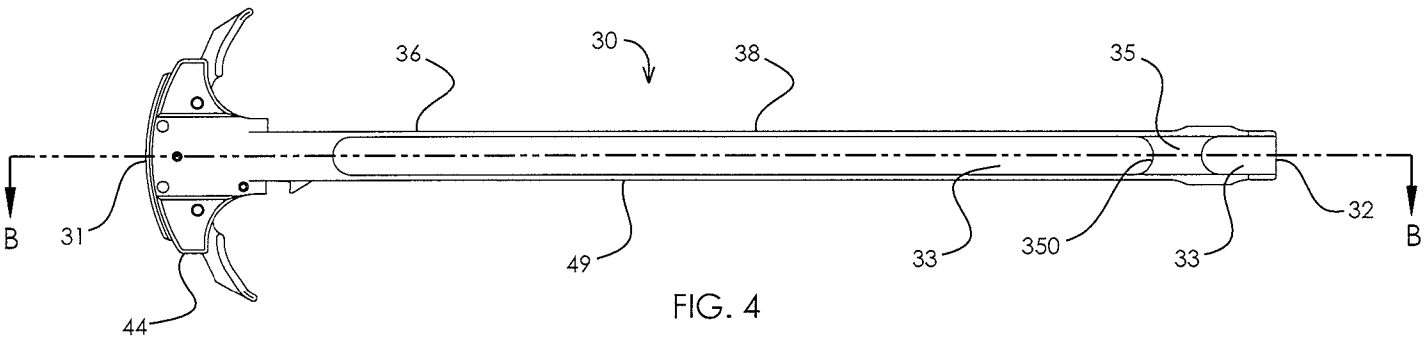
FIG. 4 is a bottom view of the charging handle of FIG. 3 of the firearm of FIGS. 1 and 2.
Figure 5:
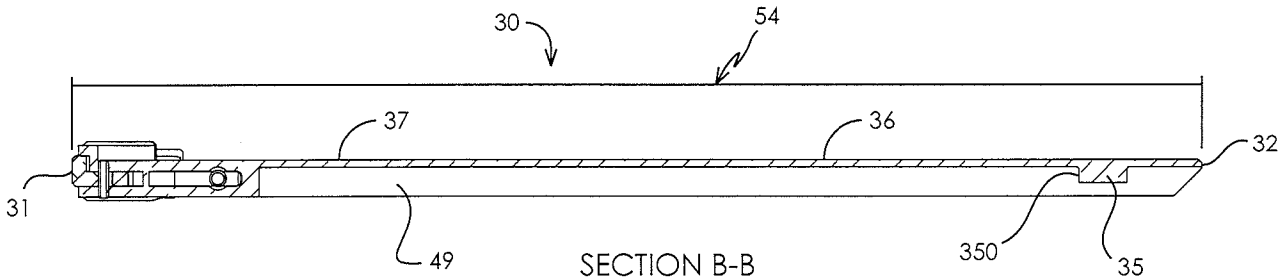
FIG. 5 is a right side cross-sectional view of the charging handle of FIGS. 3 and 4 of the firearm of FIGS. 1 and 2 taken along section B-B in FIG. 4.

In particular embodiments of a firearm (e.g., 10), the charging handle (e.g., 30) includes a bridge (e.g., 35, as mentioned) and the bridge engages the gas key (e.g., 23), gas key tab (e.g., 24), or carrier key (e.g., 23), for instance. In certain embodiments, the charging handle (e.g., 30) includes a stem (e.g., 36 identified in FIGS. 3-5) that includes a top wall (e.g., 37 identified in FIGS. 3 and 5), a left wall (e.g., 49 identified in FIGS. 4 and 5), a right wall (e.g., 38 identified in FIGS. 3 and 4), or a combination thereof (e.g., all three such walls or, in certain embodiments, just a left wall and a right wall). In some embodiments, for example, the stem (e.g., 36) is slender or elongated, has a uniform or substantially uniform height along its length (e.g., as shown in FIGS. 3 and 5), has a uniform or substantially uniform width along its length (e.g., as shown in FIG. 4), has a uniform or substantially uniform cross section along its length (e.g., excluding a bridge, for instance, 35), has a left wall (e.g., 49) that extends along its length, has a right wall (e.g., 38) that extends along its length, or a combination thereof (e.g., as shown). As used herein, "uniform" means to within 10 percent of the major dimension, and "substantially uniform" means to within 25 percent of the major dimension.

As used herein, a member or region is considered to be slender if it has a length dimension that is at least five times longer than any major dimension that is perpendicular to the length dimension. Further, as used herein, a member or region is considered to be elongated if it has a length dimension that is at least ten times longer than any major dimension that is perpendicular to the length dimension. As used herein, stem 36 does not include the bezel or head 44 of charging handle 30, shown in FIG. 4, that has a significantly larger lateral dimension than left wall 49, right wall 38, and top wall 37.

Moreover, in particular embodiments, the bridge (e.g., 35) extends from the left wall (e.g., 49) to the right wall (e.g., 38). In some embodiments, the left wall (e.g., 49) is attached to the top wall (e.g., 37) and the right wall (e.g., 38) is attached to the top wall. Moreover, in some embodiments, the left wall (e.g., 49), the top wall (e.g., 37), and the right wall (e.g., 38) are all one piece (e.g., of material, such as aluminum or plastic). As used herein, two or more walls that are all one piece are considered to be "attached". Further still, in some embodiments, the left wall is substantially perpendicular to the top wall, the right wall is substantially perpendicular to the top wall, or both. As used herein, "substantially perpendicular" means perpendicular to within 15 degrees. Even further, in certain embodiments, the left wall is perpendicular to the top wall, the right wall is perpendicular to the top wall, or both. As used herein, in this context, "perpendicular" (i.e., without being preceded by "substantially") means perpendicular to within 5 degrees.

Further, in some embodiments, the left wall (e.g., 49) is substantially parallel to the right wall (e.g., 38). As used herein, "substantially parallel" means parallel to within 15 degrees. Even further, in particular embodiments, the left wall is parallel to the right wall. As used herein, "parallel" (i.e., without being preceded by "substantially") means parallel to within 5 degrees. In some embodiments, the bridge (e.g., 35) is attached to the left wall, to the right wall, or both. Still further, in some embodiments, the bridge, the left wall, and the right wall are all one piece. Even further still, in some embodiments, the left wall, the right wall, and the top are all one piece. In a number of embodiments, the stem (e.g., 36) of the charging handle (e.g., 30) has an open bottom (e.g., 33), for example, between the left wall (e.g., 49) and the right wall (e.g., 38). This is illustrated, for example, in FIG. 4. Moreover, in some embodiments, the bridge (e.g., 35) is substantially perpendicular to the left wall, to the right wall, or both. In certain embodiments, the bridge is perpendicular to the left wall and to the right wall. Furthermore, in some embodiments, the bridge extends to the top wall (e.g., 37), while in other embodiments, the bridge is separated (e.g., by a space or gap, not shown) from the top wall, as another example.

Moreover, in a number of embodiments, the stem (e.g., 36) has an open bottom (e.g., 33), for instance, between the left wall (e.g., 49) and the right wall (e.g., 38), for example, over at least a majority of the length of the stem. In some embodiments (e.g., as shown), for example, the stem, or part of the stem, can be a channel or have a "U"-shaped cross section, for instance (e.g., an upside down "U" in the embodiment illustrated). As used herein, a stem (e.g., 36) is considered to have an "open bottom" between the left wall (e.g., 49) and the right wall (e.g., 38) if the stem is hollow over a majority of the length of the stem, the hollow interior of the stem is bounded by at least two walls (e.g., at least two of the left wall, the right wall and the top wall), and the bottom of the stem, over a majority of the area of the bottom of the stem, is defined by ends of walls (e.g., the bottom end of the left wall and the bottom end of the right wall), wherein the ends of the walls are limited to the thickness of these walls. As used herein, stem 36, as shown, has an open bottom (e.g., 33 shown in FIG. 4).

In various embodiments, the charging handle has an aft or a rearward first end (e.g., 31 identified in FIGS. 3-5), a forward second end (e.g., 32 identified in FIGS. 3-5), and a length (e.g., 54, identified in FIG. 5, for instance, parallel to the axis of barrel 13 of firearm 10) from the first end (e.g., 31) to the second end (e.g., 32). As used herein, "rearward" or "aft" means the direction opposite to the direction that the bullet travels when the weapon is fired and the bullet leaves the barrel (e.g., 13). Further, as used herein, "forward" means the direction that the bullet travels in when the weapon is fired and the bullet leaves the barrel. Thus, as used herein, "rearward" is opposite to "forward".

In some embodiments, the bridge (e.g., 35) engages the gas key (e.g., 23), gas key tab (e.g., 24), or carrier key (e.g., gas key 23), as examples, at least 2.5 percent of the length (e.g., 54) from (i.e., aft of) the (i.e., forward) second end of the charging handle (e.g., 30). Further, in different embodiments, the bridge engages the gas key, gas key tab, or carrier key at least 5 percent, at least 7.5 percent, at least 10 percent, or at least 12.5 percent of the length from (e.g., aft of) the forward or second end of the charging handle, as examples. Further still, in some embodiments, the bridge (e.g., 35) engages the gas key (e.g., 23), gas key tab (e.g., 24), or carrier key (e.g., 23) at least 50 percent of the length (e.g., 54) from the first end (e.g., 31) of the charging handle (e.g., 30). In other embodiments, as other examples, the bridge engages the gas key, gas key tab, or carrier key at least 25, 40, 60, or 75 percent of the length from the rearward or first end of the charging handle. Even further, in different embodiments, the bridge engages the gas key, gas key tab, or carrier key no more than 80, 60, 50, 40, 30, 25, 20, 17.5, or 15 percent of the length from the forward or second end (e.g., 32) of the charging handle, as examples.

In some embodiments, the gas key (e.g., 23), gas key tab (e.g., 24), or carrier key is metal, such as steel or stainless steel, as examples. In various embodiments, the gas key (e.g., 23), gas key tab (e.g., 24), or both, are sufficiently robust to withstand the forces involved (e.g., from charging handle 30), even when charged many times, and even if the operator pulls (i.e., on head 44 of charging handle 30) harder than necessary to charge the firearm (e.g., 10). Further, in a number of embodiments, the bridge (e.g., 35) has an engagement face (e.g., 350 identified in FIGS. 3-5) that engages the gas key (e.g., 23), gas key tab (e.g., 24), or carrier key, as examples. Still further, in a number of embodiments, the engagement face is substantially perpendicular or perpendicular to the left wall (e.g., 49), to the right wall (e.g., 38), or both. Further, in some embodiments, the engagement face (e.g., 350) is substantially perpendicular or perpendicular to the top wall (e.g., 37). Further still, in some embodiments, the engagement face is concave (e.g., as shown in FIG. 4), for example, toward the first end (e.g., 31). In various embodiments, the engagement face (e.g., 350) is at least five percent of the length (e.g., 54) from the second end (e.g., 32) of the charging handle (e.g., 30), the engagement face is at least 50 percent of the length (e.g., 54) from the first end (e.g., 31) of the charging handle, or both. Even further, in some embodiments, the engagement face is at least 30, 40, 50, 60, 70, 75, or 80 percent of the length (e.g., of the charging handle) from the rearward or first end of the charging handle, as other examples. In various embodiments, the engagement face is at least 2, 4, 6, 8, 10, or 12 percent of the length from the second end of the charging handle, as examples.

Other embodiments include a firearm (e.g., 10) including a carrier (e.g., 20) and a charging handle (e.g., 30) wherein the charging handle includes a bridge (e.g., 35) and the bridge engages a gas key (e.g., 23), gas key tab (e.g., 24), or carrier key of the carrier. Further, other embodiments include a charging handle (e.g., 30) for a firearm that has a carrier (e.g., 20), the charging handle including a bridge (e.g., 35) wherein the bridge engages a gas key (e.g., 23), gas key tab (e.g., 24), or carrier key of the carrier (e.g., 20). Still further, other embodiments include a firearm including a carrier and a charging handle wherein the charging handle comprises a stem (e.g., 36) including a top wall (e.g., 37), a left wall (e.g., 49), a right wall (e.g., 38), and a bridge (e.g., 35) that extends from the left wall to the right wall, and wherein the bridge engages the carrier (e.g., 20) of the firearm (e.g., 10). Even further, other embodiments include a charging handle for a firearm having a carrier, the charging handle including a stem including a top wall, a left wall, a right wall, and a bridge that extends from the left wall to the right wall, wherein the bridge engages the carrier of the firearm. Even further still, these embodiments can further include any combination of the other features described herein.

Moreover, in different embodiments, the firearm (e.g., 10) is a rifle, for example, an assault rifle (e.g., as shown in FIG. 1). In certain embodiments, for instance, the firearm (e.g., 10) is an AR-15 or an M-16 (e.g., as shown). Moreover, in different embodiments, the firearm is a semi-automatic firearm or a fully-automatic firearm. In some embodiments, for example, the firearm is a .308 caliber weapon. Further, in particular embodiments, the firearm is a rifle configured to selectably (e.g., via operation of a selector lever) fire in a fully-automatic mode and in a semi-automatic mode. Other embodiments, however, may differ.

Further, in some embodiments, for example, in which the charging handle (e.g., 30) includes a stem (e.g., 36) including a left wall (e.g., 49), a right wall (e.g., 38), and a bridge (e.g., 35), for instance, that extends from the left wall to the right wall, the bridge engages the gas key (e.g., 23, for instance, at tab 24) and yet the bridge does not extend below (e.g., either) the left wall (e.g., 49) or the right wall (e.g., 38). An example is illustrated in FIGS. 3 and 5. In this context, "below" means when the firearm (e.g., 10, for instance, an AR-15) is in its normal orientation for firing, with the barrel (e.g., 13) horizontal (e.g., as shown in FIG. 1). In a number of embodiments, the top wall (e.g., 37) of the charging handle (e.g., 30) of the firearm (e.g., 10) is level when the firearm (e.g., 10) is in its normal orientation for firing. Still further, in various embodiments, the charging handle (e.g., 30) does not require, or does not include a drop down tab (e.g., at forward end 32), which can bend or break off. Even further, in a number of embodiments, the charging handle (e.g., 30) does not require, or does not include a drop down tab that extends below (e.g., either) the left wall (e.g., 49) or the right wall (e.g., 38).

In some embodiments, the bridge (e.g., 35) extends about half way down from the top wall (e.g., 37) of the charging handle (e.g., 30) to the bottom of the left wall (e.g., 49), the bottom of the right wall (e.g., 38), or both (e.g., as shown in FIGS. 3 and 5). In this context, "about" means to within plus or minus 15 percent. Further, in some embodiments, the bridge (e.g., 35) extends half way down from the top wall (e.g., 37) of the charging handle (e.g., 30) to the bottom of the left wall (e.g., 49), the bottom of the right wall (e.g., 38), or both to within 5, 10, 20, 25, 30, 35, or 40 percent, as other examples. Further still, in various embodiments, bridge (e.g., 35) extends downward from the top wall (e.g., 37) of the charging handle (e.g., 30) less far than the bottom of the left wall (e.g., 49), the bottom of the right wall (e.g., 38), or both (e.g., as shown in FIGS. 3 and 5).

Various other embodiments, besides firearms (e.g., 10), include charging handles (e.g., 30) for firearms (e.g., 10), as other examples. In particular embodiments, for instance, the firearm (e.g., 10) has a carrier (e.g., 20) having a gas key (e.g., 23), and the charging handle (e.g., 30) includes an engagement face (e.g., 350), for instance, that engages the carrier (e.g., 20) at the gas key (e.g., 23). Further, in some embodiments, the charging handle (e.g., 30) engages a tab (e.g., 24), for example, on the gas key (e.g., 23). Still further, in particular embodiments, the charging handle (e.g., 30) includes a stem (e.g., 36), for instance, including a top wall (e.g., 37), a left wall (e.g., 49), for example, attached to the top wall (e.g., 37), a right wall (e.g., 38), for instance, attached to the top wall (e.g., 37), and a bridge (e.g., 35), for example, that extends from the left wall (e.g., 49) to the right wall (e.g., 38).

Even further, in some embodiments, the bridge (e.g., 35) engages the gas key (e.g., 23), the left wall (e.g., 49) is substantially perpendicular to the top wall (e.g., 37), the right wall (e.g., 38) is substantially perpendicular to the top wall (e.g., 37), or a combination thereof. Further still, in some embodiments, the left wall (e.g., 49) is substantially parallel to the right wall (e.g., 38). Moreover, in particular embodiments, the bridge (e.g., 35), the left wall (e.g., 49), the right wall (e.g., 38), and the top wall (e.g., 37) are all one piece, the stem (e.g., 36) has an open bottom (e.g., 33), for instance, between the left wall (e.g., 49) and the right wall (e.g., 38), the bridge (e.g., 35) is substantially perpendicular to the left wall (e.g., 49) and to the right wall (e.g., 38), or a combination thereof, as examples.

In particular embodiments in which the charging handle (e.g., 30) includes a stem (e.g., 36) having a left wall (e.g., 49), a right wall (e.g., 38), and a bridge (e.g., 35), for instance, that extends from the left wall to the right wall, the bridge (e.g., 35) engages the gas key (e.g., 23), the left wall (e.g., 49) is substantially parallel to the right wall (e.g., 38), the bridge (e.g., 35) does not extend below the left wall (e.g., 49), the bridge (e.g., 35) does not extend below the right wall (e.g., 38), or a combination thereof. Further, in certain embodiments, the engagement face (e.g., 350), the bridge (e.g., 35) or both, is located between the first end (e.g., 31) and the second end (e.g., 32) of the charging handle (e.g., 30). In particular embodiments, the engagement face is at least five percent of the length (e.g., 54) from the second end of the charging handle, no more than twenty percent of the length from the second end of the charging handle, or both. Other ranges are also identified herein. Still further, various embodiments of charging handles include other features described herein.

Still other embodiments include various carriers (e.g., 20) for firearms (e.g., 10). In a number of embodiments, for example, the firearm (e.g., 10) has a charging handle (e.g., 30) and the carrier (e.g., 20) includes a gas key (e.g., 23), for instance, that includes a tab (e.g., 24), for example, that engages the charging handle (e.g., 30) of the firearm (e.g., 10). Further, in particular embodiments, the charging handle (e.g., 30) includes a stem (e.g., 36), for instance, including a left wall (e.g., 49), a right wall (e.g., 38), a bridge (e.g., 35), for instance, that extends from the left wall to the right wall, or a combination thereof. Further still, in some embodiments, the tab (e.g., 24), for instance, on the gas key (e.g., 24) of the carrier (e.g., 20) extends, for example, upward, for instance, between the left wall (e.g., 49) and the right wall (e.g., 38). In a number of embodiments, for example, the tab (e.g., 24), for instance, on the gas key (e.g., 24) of the carrier (e.g., 20) engages the bridge (e.g., 35) on the charging handle (e.g., 30). Even further, in this context, "upward" means when the firearm (e.g., 10, for instance, an AR-15) is in its normal orientation for firing, with the barrel (e.g., 13) horizontal (e.g., as shown in FIG. 1).

Examples of methods include various methods of obtaining or providing an apparatus for pulling back the carrier (e.g., 20) of a firearm (e.g., 10), for instance, with a charging handle (e.g., 30). In various embodiments, such a method can include, for example, in any order, at least certain acts. Such acts can include, for instance, obtaining or providing a charging handle (e.g., 30) having a rearward first end (e.g., 31), a forward second end (e.g., 32), and a length (e.g., 54), for instance, from the first end (e.g., 31) to the second end (e.g., 32). Further, some embodiments include obtaining or providing a carrier (e.g., 20). In a number of embodiments, the charging handle (e.g., 30) engages the carrier (e.g., 20) at an engagement face (e.g., 350) on the charging handle located between the first end (e.g., 31) and the second end (e.g., 32). Further, in particular embodiments, the engagement face (e.g., 350) is at least five percent of the length (e.g., 54) from the second end (e.g., 32) of the charging handle (e.g., 30).

Some embodiments include an act of obtaining or providing a charging handle (e.g., 30), for instance, having a stem (e.g., 36) that includes a top wall (e.g., 37), a left wall (e.g., 49), a right wall (e.g., 38), or a combination (e.g., all) thereof. In some embodiments, the charging handle further includes a bridge (e.g., 35) or an engagement face (e.g., 350) (or both), for example, extending from the left wall (e.g., 49) to the right wall (e.g., 38), for instance, wherein the charging handle (e.g., 30) engages the carrier (e.g., 20) at the engagement face (e.g., 350). In a number of embodiments, the charging handle (e.g., 30) or the feature (e.g., bridge 35 or engagement face 350) of the charging handle engages the gas key (e.g., 23), gas key tab (e.g., 24), or carrier key (e.g., gas key 23) of the carrier (e.g., 20), as examples. In various embodiments, particular methods can include acts of obtaining or providing, as examples, other features, components, or aspects described herein. All possible combinations are contemplated. Further, the order in which acts are described is an example of the order in which these acts can be performed, but in other embodiments, unless stated otherwise herein, the acts may be performed in a different order. In some embodiments, various acts may overlap or be performed at the same time, as another example.

Other examples of methods include methods of using of a firearm or charging handle and methods of charging a firearm. In a number of embodiments, for example, the operator of the firearm (e.g., 10) pulls (e.g., with the operator's hand or one or more fingers) rearward or aft on the charging handle (e.g., on rearward end 31 of charging handle 30 or on head 44). In various embodiments, the bridge (e.g., 35) or engagement face (e.g., 350) engages the gas key (e.g., 23), or specifically, in some embodiments, the gas key tab (e.g., 24), for example, on the carrier (e.g., 20), which pulls the carrier aft, for instance, along with the bolt. In a number of embodiments, the operator pulls the charging handle (e.g., 30) rearward until it stops, which occurs when the charging handle is at its rearward most position, for example, compressing the buffer spring. At that point, the operator allows the charging handle to return forward, for instance, pushed by the carrier (e.g., 20), which is pushed by the buffer spring, which loads a round from the magazine into the chamber and secures the bolt, in a number of embodiments. Once the carrier has moved fully forward, in various embodiments, the operator pushes the charging handle (e.g., 30) further forward into its stowed position in the upper receiver (e.g., 11). In a number of embodiments, the firearm (e.g., 10) is now charged and ready to fire.

Further, various embodiments of the subject matter described herein include various combinations of the acts, structure, components, and features described herein, shown in the drawings, described in documents that are incorporated by reference herein, or that are known in the art. Moreover, certain procedures can include acts such as manufacturing, obtaining, or providing components that perform functions described herein or in the documents that are incorporated by reference. The subject matter described herein also includes various means for accomplishing the various functions or acts described herein, in the documents that are incorporated by reference, or that are apparent from the structure and acts described. Each function described herein is also contemplated as a means for accomplishing that function, or where appropriate, as a step for accomplishing that function.

Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. A firearm comprising a charging handle and a carrier having a gas key wherein:

the charging handle engages the carrier at the gas key;

the charging handle comprises a stem comprising a left wall, a right wall, and a bridge that extends from the left wall to the right wall;

the bridge engages the gas key;

the bridge does not extend below the left wall; and the bridge does not extend below the right wall.

2. The firearm of claim 1 wherein the gas key comprises a tab that engages the charging handle.

3. The firearm of claim 2 wherein: the charging handle comprises a stem comprising a left wall, a right wall, and a bridge that extends from the left wall to the right wall; and the tab extends between the left wall and the right wall to engage the bridge.

4. The firearm of claim 1 wherein: the charging handle comprises a stem comprising a top wall, a left wall attached to the top wall, and a right wall attached to the top wall, and a bridge that extends from the left wall to the right wall; and the bridge engages the gas key.

5. The firearm of claim 4 wherein: the left wall, the top wall, and the right wall are all one piece; the left wall is substantially perpendicular to the top wall; the right wall is substantially perpendicular to the top wall; and the left wall is substantially parallel to the right wall.

6. The firearm of claim 4 wherein: the bridge, the left wall, the right wall, and the top wall are all one piece; and the stem has an open bottom between the left wall and the right wall.

7. The firearm of claim 4 wherein the bridge is perpendicular to the left wall and to the right wall.

8. The firearm of claim 4 wherein the bridge extends to the top wall.

9. The firearm of claim 4 wherein: the bridge comprises an engagement face that engages the gas key; and the engagement face is concave.

10. The firearm of claim 1 wherein: the charging handle has a rearward first end, a forward second end, and a length from the first end to the second end; and the charging handle engages the gas key at least 10 percent of the length from the second end of the charging handle.

11. The firearm of claim 10 wherein the bridge engages the gas key at least 50 percent of the length from the first end of the charging handle.

12. The firearm of claim 11 wherein:

the charging handle comprises a stem comprising a top wall, a left wall attached to the top wall, a right wall attached to the top wall, and a bridge that extends from the left wall to the right wall;

the left wall is substantially perpendicular to the top wall; the right wall is substantially perpendicular to the top wall; the left wall is substantially parallel to the right wall;

the bridge, the left wall, the right wall, and the top wall are all one piece; the stem has an open bottom between the left wall and the right wall; the bridge extends to the top wall; and the bridge comprises an engagement face that engages the gas key.

13. The firearm of claim 1 wherein the firearm is an AR-15.

14. A charging handle for a firearm having a carrier having a gas key, the charging handle comprising:

an engagement face that engages the carrier at the gas key;

the charging handle comprises a stem comprising a left wall, a right wall, and a bridge that extends from the left wall to the right wall;

the bridge engages the gas key;

the left wall is substantially parallel to the right wall; the bridge does not extend below the left wall; and the bridge does not extend below the right wall.

15. The charging handle of claim 14 wherein the charging handle engages a tab on the gas key.

16. The charging handle of claim 14 wherein:

the charging handle comprises a stem comprising a top wall, a left wall attached to the top wall, a right wall attached to the top wall, and a bridge that extends from the left wall to the right wall;

the bridge engages the gas key;

the left wall is substantially perpendicular to the top wall; the right wall is substantially perpendicular to the top wall; the left wall is substantially parallel to the right wall;

the bridge, the left wall, the right wall, and the top wall are all one piece; and the stem has an open bottom between the left wall and the right wall.

17. A carrier for a firearm having a charging handle, the carrier comprising:

a gas key comprising a tab that engages the charging handle of the firearm; and the charging handle comprises a stem comprising a left wall, a right wall, and a bridge that extends from the left wall to the right wall; and the tab on the gas key of the carrier extends upward between the left wall and the right wall to engage the bridge on the charging handle.

* * * * *